US006722087B1

(12) United States Patent
Morello

(10) Patent No.: US 6,722,087 B1
(45) Date of Patent: Apr. 20, 2004

(54) BUILDING PANEL AND PANEL CRIMPING MACHINE

(75) Inventor: Frederick Morello, Johnstown, PA (US)

(73) Assignee: MIC Industries, Reston, VA (US)

( * ) Notice: Subject to any disclaimer, the term of this patent is extended or adjusted under 35 U.S.C. 154(b) by 139 days.

(21) Appl. No.: 09/666,705

(22) Filed: Sep. 21, 2000

(51) Int. Cl.[7] ..... E04B 1/32
(52) U.S. Cl. ..... 52/86; 52/537; 52/783.11
(58) Field of Search ..... 52/528, 529, 86, 52/19, 537, 519, 518, 520, 478, 530, 531, 87, 783.11, 335, 336, 338

(56) References Cited

U.S. PATENT DOCUMENTS

| | | | | | |
|---|---|---|---|---|---|
| 409,309 | A | | 8/1889 | Shellaberger | |
| 1,015,429 | A | | 10/1912 | Fahrney | |
| 3,708,943 | A | * | 1/1973 | Thomas et al. | 52/309.8 |
| 4,224,775 | A | * | 9/1980 | Heckelsberg | 52/528 |
| 4,364,253 | A | | 12/1982 | Knudson | 72/187 |
| 4,453,364 | A | * | 6/1984 | Ting | 52/630 |
| 4,470,186 | A | | 9/1984 | Knudson | 29/243.5 |
| 4,505,084 | A | * | 3/1985 | Knudson | 52/528 |
| 4,505,143 | A | | 3/1985 | Knudson | 72/187 |
| 4,627,258 | A | | 12/1986 | Loges et al. | |
| 4,675,238 | A | * | 6/1987 | Karoubas | 428/599 |
| 4,741,134 | A | * | 5/1988 | Stohs | 174/48 |
| D337,169 | S | * | 7/1993 | Schipp | 52/794 |
| 5,243,748 | A | | 9/1993 | Morello | 29/243.5 |
| 5,249,445 | A | | 10/1993 | Morello | 72/9 |
| 5,318,236 | A | | 6/1994 | Morello et al. | 242/72 |
| 5,359,871 | A | | 11/1994 | Morello | 72/7 |
| 5,393,173 | A | * | 2/1995 | Morello | 405/151 |
| 5,469,674 | A | | 11/1995 | Morello | |
| 5,584,198 | A | | 12/1996 | Morello et al. | 72/8.3 |
| 5,604,966 | A | | 2/1997 | Morello et al. | 29/243.58 |
| 5,623,805 | A | | 4/1997 | Morello | 52/749.1 |
| 5,960,662 | A | | 10/1999 | Morello | 72/166 |
| 5,966,791 | A | | 10/1999 | Morello et al. | 29/243.5 |
| 5,980,156 | A | * | 11/1999 | Morello et al. | 405/124 |

* cited by examiner

*Primary Examiner*—Carl D. Friedman
*Assistant Examiner*—Chi Q Nguyen
(74) *Attorney, Agent, or Firm*—Jones Day; Blaney Harper; Russell O. Paige

(57) ABSTRACT

The present invention is an improved building panel having increased strength and rigidity, thereby reducing present design constraints imposed upon buildings constructed of interconnected panels. The building panel includes notched inclined side walls extending from a central portion, wherein the notched portions are located between a neutral imaginary axis and the central portion. The notched portions have an open end and a closed end, wherein the open end faces away from the building panel. Including such notched portions within the inclined side walls provides the building panel with increased strength and rigidity, thereby allowing the building panel to withstand increased positive and negative bending moments. Thus, a building constructed of panels having such notched side walls will reduce the present design constraints and increase the size and shape of buildings constructed of such panels.

20 Claims, 9 Drawing Sheets

BUILDING PANEL AND PANEL CRIMPING MACHINE

TECHNICAL FIELD

This invention relates to a building panel and a building structure comprising a plurality of interconnected building panels. This invention also relates to a panel forming apparatus and more particularly, to a crimping machine within the panel forming apparatus.

BACKGROUND

Most buildings are constructed of a combination of columns (i.e., posts) and beams, which are covered by plywood or some sort of metal or plastic sheeting. In an effort to reduce the overall construction time, however, contractors often construct buildings, and particularly, the exterior walls of buildings, with prefabricated building panels. Constructing a building with such panels increases efficiency because rather than assembling individual components on site, entire wall panels are manufactured on the construction site so that they can be swiftly combined and installed. These prefabricated panels are typically manufactured from steel sheet metal. Thereafter, two panels are placed adjacent to one another and the sides of the panels engage and form a sealed joint.

These interconnected panels may by straight or arched (i.e., curved). Arched panels are typically used to construct an entire metal building. For example, the roof panels are completely arched and extend to the foundation. The design of these buildings is such that the roof panels continue downward and also form the side walls of the building, thereby creating a semi-circular shaped building when viewed from the end.

An arched building constructed of panels has its advantages, but it also has a number of limitations. For example, these panels are typically shaped and sealed together by a single machine, but some of the machines have limited ability to form panels having multiple shapes and sizes. Specifically, the machine's inability to bend and form certain types and gauges of metal may limit the thickness of the panel, which, in turn, limits the panel's strength and rigidity. Thus, a builder is often restricted to the sizes and shapes of buildings that can be constructed of such panels.

Straight panels also have various positive and negative attributes. Regardless of whether the panel is arched or straight, FIG. 1 illustrates a cross section of a known building panel. If the panel is arched, it is bent in a direction about an imaginary axis A—A. The building panel 100 includes a central portion 102 and two inclined side wall portions 110, 112 extending from opposite ends of the central portion 102. The central portion 102 includes a notched portion 108, thereby separating the central portion 102 into two sub-central portions 104, 106.

The building panel 100 also includes two wing portions 114, 116 extending from the inclined side wall portions 110, 112, respectively. A hook portion 120 extends from one wing portion 116, and a receptacle portion 118 extends from the other wing portion 114. As illustrated in FIG. 2, the hook and receptacle portions are designed to interconnect and form a building structure 200 when two building panels 100 are placed adjacent to one another. A further detailed description of this connection mechanism is discussed in U.S. Pat. No. 5,393,173 which is hereby incorporated by reference.

As additional building panels are connected to one another, however, the size of the building structure increases. Therefore, depending upon the orientation of the building structure, the weight of the additional panels may cause the building structure to deflect. Specifically, FIG. 2 illustrates imaginary axis A—A, which intersects the middle of the building panels 100 and the building structure 200. As the building panel bends from axis A—A towards the wing portions 114, 116, the building panel is subject to a positive bending moment. Similarly, as the building panel bends from axis A—A towards the central portion 102, the building panel is subject to a negative bending moment. The size of the bending moment is a function of the amount of force acting upon the building panel and the distance applying such force. Thus, as the force and distance increase, so does the bending moment.

The weight of the building structure is an example of one type of applied force. As the size of the building structure increases, so does its weight. Therefore, as the size of the building structure increases, the building panels are subject to increased bending moments, the direction of which are dependent upon the orientation of the building structure. The inability of the building panels to withstand such bending moments, in turn, imparts design constraints on the building, thereby limiting its size and shape.

The building structure is also subject to other types of horizontal and vertical loads that increase the positive and negative bending moments. As mentioned above, the building panels typically form the exterior walls of a building. Thus, the building panel's are exposed and subject to dynamic climatic changes. For example, snow may accumulate on the roof of a building, thereby imparting a vertical load upon the building panel. Additionally, wind may blow against the side of the building, thereby subjecting the building panel to a horizontal force. These horizontal and vertical forces, caused by the weather, in turn, create additional bending moments. Therefore, these weather conditions impart additional design constraints, thereby further limiting the size and shape of buildings that can be constructed from such panels.

Referring to FIG. 4, there is shown a perspective view of the building panel 100 that is illustrated in FIG. 1. This figure illustrates that the central portion 102 and inclined side wall portions 110, 112 are corrugated. These corrugations 402 are typically formed by passing the panel through a crimping machine. These corrugations (or crimps) generally allow the panels to be formed into a curved shape, the curve having a radius that is a function of crimp depth and spacing. Upon being crimped, the panel's strength and rigidity increases. However, in order to withstand additional bending moments further increased strength and rigidity is required.

The process of forming these corrugations can also present other problems. For example, the crimping machine that forms these corrugations often causes the depth of the corrugations on the inclined side walls of the panel to remain constant while the curve radius of the panel is being changes. Thus, if the curve radius of the panel is tight and the depth of the side wall corrugation is shallow, the inclined side wall buckles due to the excess material not taken up by the corrugation.

The central portion (i.e., belly) of the panel is also typically crimped. Similar to the inclined side wall problem above, if the radius is large or the panel section being formed is straight and the depth of the side corrugation is deep, the central portion of the panel buckles due to the excess material in the central portion not taken up by the crimping process.

Also, the inclined side wall crimping machine and the central portion crimping machine, often referred to as the main crimping apparatus, are physically located apart from one another. Thus, if it is desirable to simultaneously adjust the side wall and main crimping machines, it is not possible to change the depth of the side wall crimping machine. The inability to change the depth of the side wall crimping machine, in turn, causes the buckling effect discussed above. Therefore, there is a need to improve the side wall and main crimping machines in order to minimize the undesirable buckling effects caused by the adjustment of such machines.

OBJECTS OF THE INVENTION

It is an object of the invention to minimize the design constraints of buildings constructed of panels.

It is another object of the invention to increase the size of buildings constructed of panels.

If is another object of the invention to increase the variety of shapes of buildings constructed of panels.

It is a further object of the invention to increase the building's ability to withstand inclement weather.

It is a further object of the invention to increase the building panel's strength and rigidity.

It is a further object of the invention to increase the building panel's ability to withstand increased bending moments.

It is a further object of the invention to increase the building panel's ability to withstand increased bending moments without increasing its thickness.

It is a further object of the invention to develop a machine capable of manufacturing such an improved building panel.

It is even a further object of the invention that the machine have the capability to corrugate the improved building panel.

SUMMARY OF THE INVENTION

The present invention is an improved building panel capable of withstanding increased bending moments. The building panel includes notches (i.e., stiffeners) in the inclined side walls and bottom (i.e., belly) of the panel that provide the building panel with increased strength and rigidity, thereby allowing the building panel to withstand increased positive and negative bending moments. Thus, a building constructed of panels having stiffeners within its profile will reduce the present design constraints and increase the size and shape of buildings constructed of such panels.

The inclined side walls extend from a central portion and include stiffeners or notches located between an imaginary neutral axis and the central portion. Moreover, it is preferred that the notched portion be located approximately halfway between the imaginary neutral axis and the central portion. Placing the notch at such a location increases the panel's strength and rigidity, which, in turn, increases its ability to withstand increased bending moments.

Furthermore, the notched portion has an open end and a closed end. The open end faces away from the building panel, and the closed end faces toward the center building panel. The notched portion separates the inclined side walls into two flat portions. Including the notched portion within the side walls and directing the open end of the notch away from the building panel further increases the panels strength and rigidity, which, in turn, further increases its ability to withstand increased bending moments.

Accordingly the present invention relates to a building panel, comprising a central portion having opposite ends, a pair of inclined side wall portions extending from the opposite ends of the central portion, wherein an imaginary neutral axis intersects the inclined side wall portions, each of the inclined side wall portions comprising a notched portion located between the imaginary axis and the central portion, thereby separating each of the inclined side wall portions into two substantially flat portions, the notched portion comprising an open side and a closed side, wherein the closed side is directed towards the center of the building panel, and a pair of wing portions extending from the inclined side wall portions.

The present invention also relates to a building structure comprising a plurality of interconnected panels, wherein the panels are adjacent to one another such that the wing portions are adjacent and connected to one another.

If it is desirable to corrugate the improved building panel, it is preferable that the crimping machine be designed to accept a panel having such a notched side wall and bottom profile. Thus, the present invention also relates to a panel crimping machine that corrugates the improved building panel of the present invention. The panel crimping machine includes individual sets of crimping rollers for corrugating each of the notched side wall portions and the central portion. Particularly, each set of crimping rollers includes a male crimping roller and female crimping roller, wherein each crimping roller includes a plurality of crimping blades extending from their respective hubs. Additionally, the profiles of the male and female crimping blades includes a non-linear shape. Specifically, the profile of the male and female crimping blades matches the notched profile of the panel's inclined side walls. Thus, as the notched inclined side walls pass between the driven crimping rollers, the crimping rollers rotate and the non-linear profiled blades intersect and crimp the entire portion of the inclined side walls.

Accordingly, the panel crimping machine includes two pairs of crimping rollers offset from one another and located within the panel crimping machine such that when a panel enters the panel crimping machine, wherein the panel comprises a central portion and a pair of inclined side wall portions extending from opposite ends of the central portion, one inclined side wall portion passes through the first pair of crimping rollers and the other inclined side wall portion passes through the second pair of crimping rollers, each pair of the crimping rollers comprising a male crimping roller comprising a plurality of male crimping blades extending from its center, each of the male crimping blades having a non-linear profile, and a female crimping roller comprising a plurality of female crimping blades extending from its center, each of the female crimping blades having a non-linear profile that is complimentary to the non-linear profile of the male crimping blades, and a drive train for rotating each of the pairs of crimping rollers, whereupon rotating the crimping rollers, the male crimping blades and the female crimping blades alternately intersect one another and crimp the inclined side wall portion as the inclined side wall portion passes between the crimping rollers.

For the purposes of this disclosure, the word "nonlinear" shall mean a profile that is other than straight. For example, it shall include a crimping blade having a contoured or shaped profile other than a straight profile.

The foregoing features and advantages of the present invention will become more apparent in light of the following detailed description of exemplary embodiments thereof as illustrated in the accompanying drawings.

DESCRIPTION OF THE PREFERRED EMBODIMENTS

Figure 1:
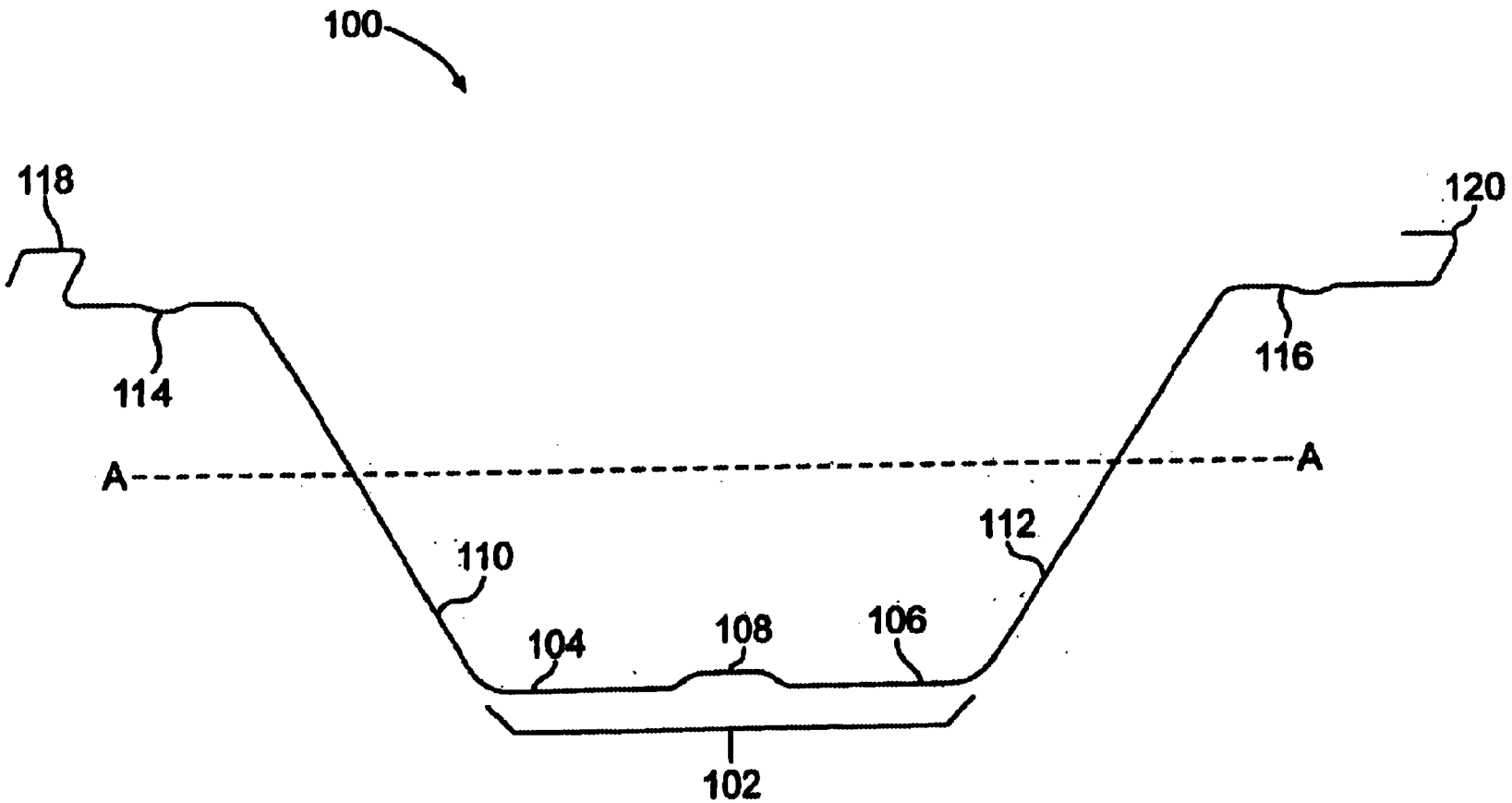
FIG. 1 is a cross sectional view of one example of a known building panel.
Figure 2:
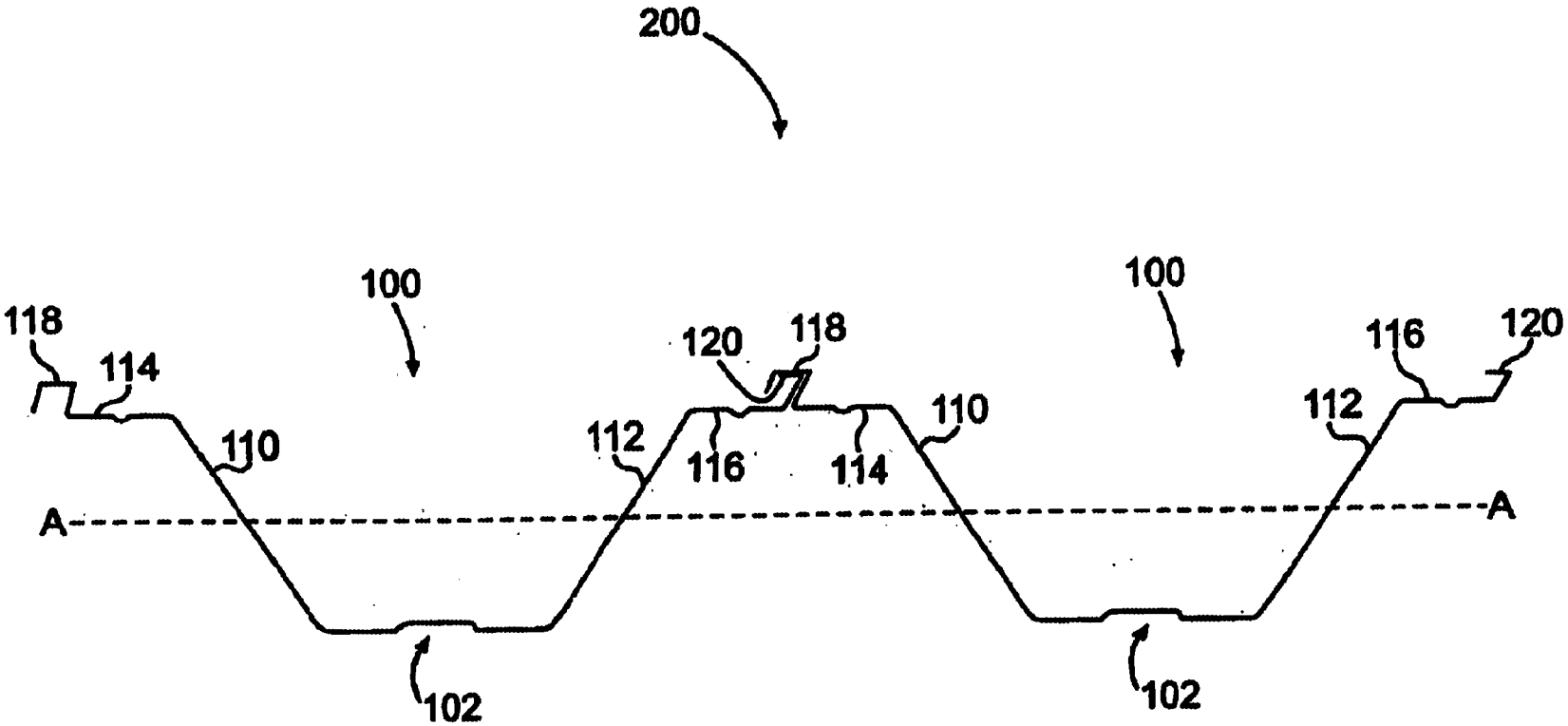
FIG. 2 is a cross sectional view of an example of a building structure comprised of plurality of building panels illustrated in FIG. 1.
Figure 3:
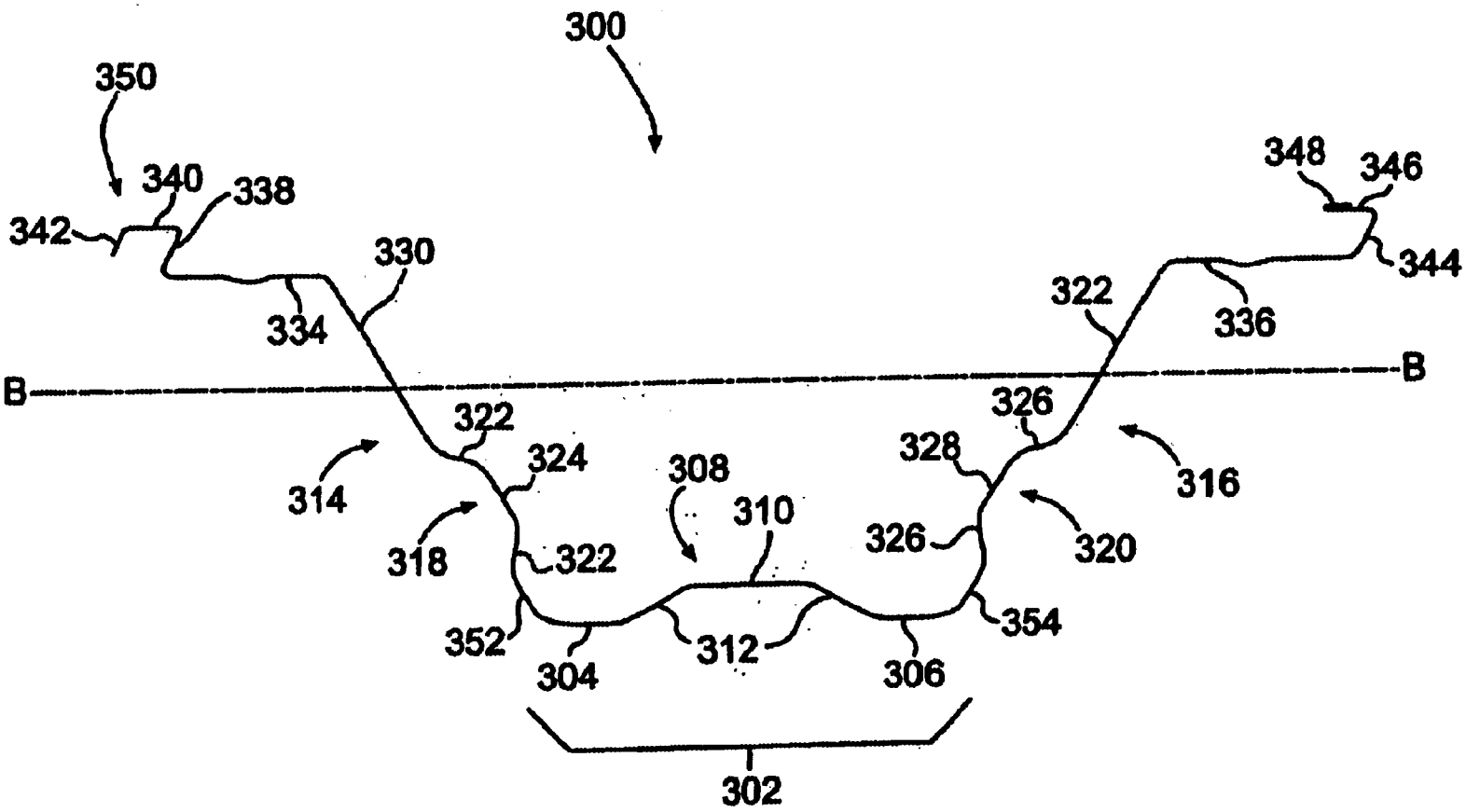
FIG. 3 is a cross sectional view of one embodiment of a building panel comprising the present invention.

Referring to FIG. 3, there is shown a panel 300 formed from a single roll of ASTM standard A-653 steel sheet metal having a thickness ranging from about 24 gauge to 16 gauge. It shall be understood that the panel 300 may be formed of numerous gauges and other materials, such as aluminum or plastic as long as the material has the desired engineering requirements and provides the necessary structural integrity. The panel 300 comprises a central portion 302 from the ends of which extend, preferably at a 45° angle, a pair of inclined side wall portions 314, 316. The panel 300 also comprises wing portions 334, 336, which extend from the outer ends of the inclined side wall portions 314, 316 in a generally horizontal fashion parallel to the central portion 302.

At the end of one wing portion 336 is a hook portion 348, which is parallel to the wing portion 336 and the central portion 302. The hook portion 348 comprises an inclined section 344 and an end section 346. Located at the end of the other wing portion 334 is a complementary receptacle portion 350 capable of receiving the hook portion 348. The receptacle portion 350 comprises an inclined section 338, an intermediate section 340 and a downward edge section 342.

The inclined section 338 of the receptacle portion 350 is parallel to the inclined section 344 of the hook portion 348. The intermediate section 340 of the receptacle portion 350 is parallel to the end section 346 of the hook portion 348, and both the intermediate section 340 and the end section 346 are parallel to the wing portions 334, 336. Thus, when two panels 300 are adjacent one another, the receptacle portion 350 from one panel and the hook portion 348 of another panel matingly engage and form a connection therebetween.

Continuing to refer to FIG. 3, a neutral imaginary axis B—B intersects the panel 300 through its center of gravity and through the inclined side wall portions 314, 316. Notched portions 318, 320 are included within the inclined side wall portions 314, 316, respectively, at a location preferably between the neutral axis and the central portion (i.e., below the neutral axis). It is even more preferable that the notched portions 318, 320 be included within the inclined side wall portions 314, 316 at approximately half-way between the neutral axis and the central portion 302. The notched portion 318 intersects the inclined side wall portion 314, thereby forming two substantially flat portions 330, 352 within such inclined side wall portion 314, and the other notched portion 320 intersects opposing inclined side wall portion 316, thereby forming two substantially flat portions 332, 354 therein.

Each of the notched portions 318, 320 comprise an open end and a closed end. The open end faces away from the panel 300, and the closed end faces toward the center of the panel 300. It is also preferable that the notched portion 318 comprise a notched central portion 324 and a pair of notched inclined side wall portions 322, such that the notched inclined side wall portions 322 connect the notched central portion 324 and the flat portions 330, 352 at a 45° angle. Similarly, the notched portion 320 comprises a notched central portion 328 and a pair of notched inclined side wall portions 326 with a complementary arrangement between themselves and the inclined side wall portion 316.

Facing the open and closed ends of the notched portions 318, 320 away and toward the center of the panel 300, respectively, and configuring the notched portions 318, 320 to comprise a notched central portion and a pair of notched inclined side wall portions increases the panel's rigidity. Similarly, placing the notched portions 318, 320 between the neutral axis and the central portion 324 also increases the panel's rigidity. Increasing the strength of the panel allows it to absorb increased horizontal and vertical forces, thereby improving the panel's ability to withstand positive and negative bending moments in comparison to panels without such notched portions. Thus, including notched portions within the inclined side walls of panels reduces the present design constraints of buildings constructed of such panels, thereby increasing the size and shape of such buildings.

The building panel's rigidity is also improved by including a notched central portion 308 within the central portion 302, thereby creating two sub-central portions 304, 306. The notched central portion 308 comprises a horizontal portion 310 and a pair of notched central inclined side wall portions 312, such that the notched central inclined side wall portions 312-connect the notched central portion 308 and the two sub-central portions 304, 306 at a 45° angle. The horizontal portion 310 is substantially parallel to the two sub-central portions 304, 306 and is at a height approximately horizontal with the intersection of the notched inclined side wall portions 322, 326 and the flat portions 352, 354, respectively. Placing the horizontal portion 310 at such a height further increases the panel's ability to withstand negative bending moments.

Figure 4:
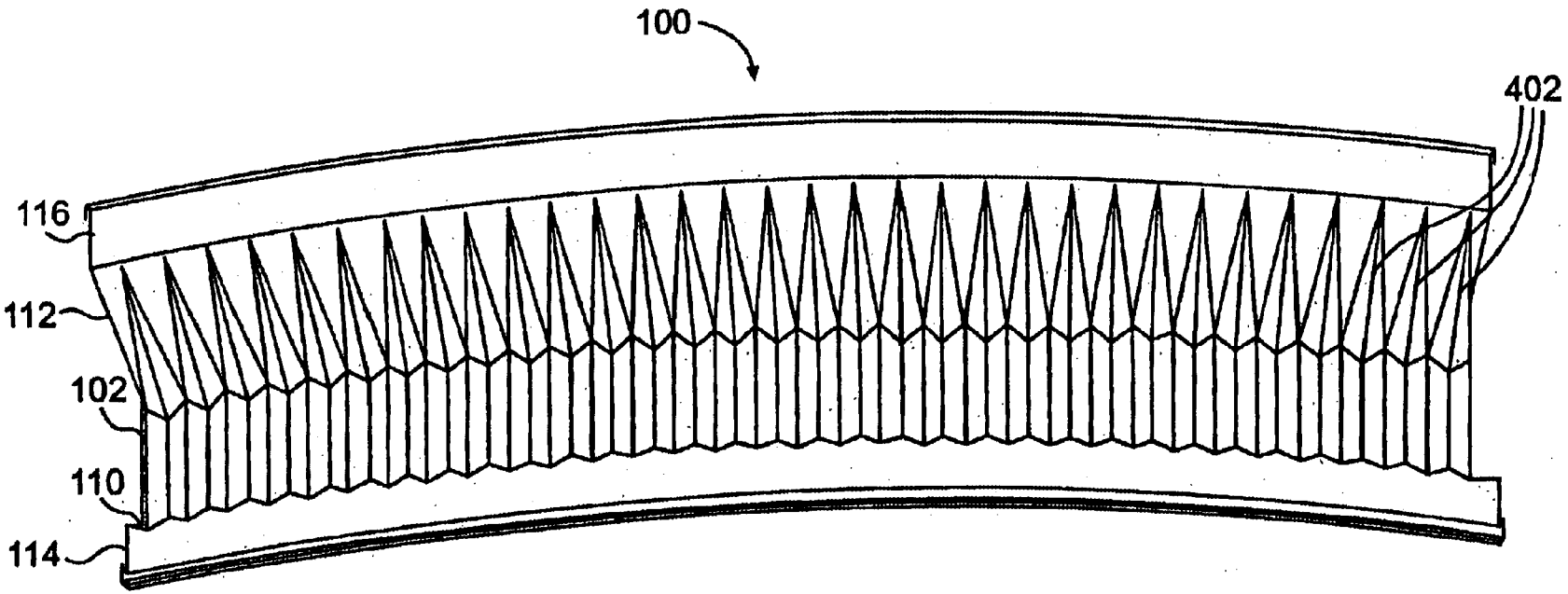
FIG. 4 is a perspective view of the known building panel illustrated in FIG. 1.
Figure 5:
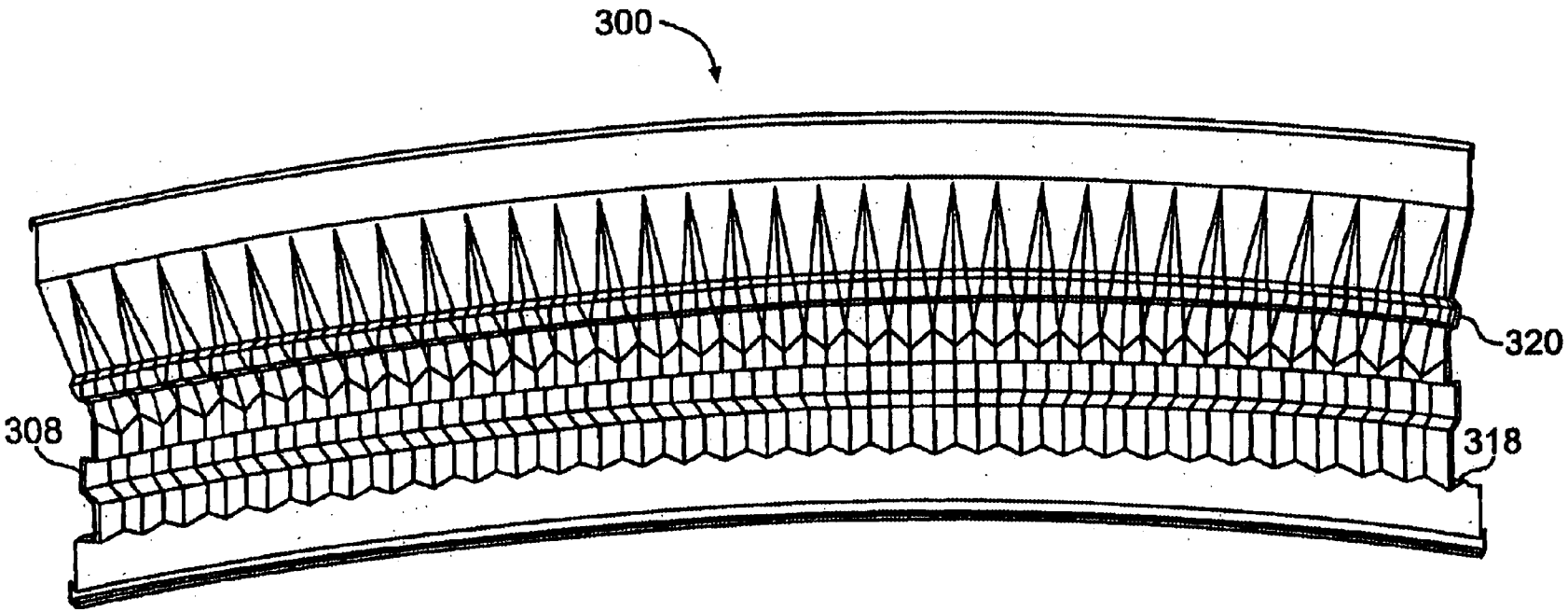
FIG. 5 is a perspective view of a building panel of the present invention as illustrated in FIG. 3.

Referring to FIGS. 4 and 5, increasing the height of the horizontal portion 310 of the notched central portion 308, along with including the notched portions 318, 320 within the side wall portions 314, 316 of the panel substantially changes the configuration of the panel. Not only does the panel include corrugations within its side wall portions, but the side wall portions also include a notched cross sectional profile. This improved configuration improves the strength and rigidity of the panel, which, in turn, improves its ability to withstand increased bending moments.

As mentioned above, these panels are typically manufactured at a construction site. Thus, as discussed in U.S. Pat. No. 5,249,445 which is hereby incorporated by reference, a machine capable of producing the panel of the present invention is preferably mounted on a trailer so as to be mobile. This provides an operator the ability to locate the machine directly at the particular construction site where a building utilizing such panels can be erected. Along one side of the trailer, the machine includes a panel forming apparatus. The components of the panel forming apparatus include a roll holder for holding a roll of sheet metal of appropriate gauge from which the building panels are formed and a roll forming machine, which includes a plurality of metal forming rolls for forming the sheet metal into the desired configuration described above in reference to FIG. 3. As the newly shaped metal exits the roll forming machine, the metal enters a hydraulically operated shear that is located at the end of the roll forming station. Upon measuring the desired length of the metal, the shear cuts the panel into appropriately sized panels.

An internal combustion engine, and preferably a diesel engine, is mounted on the trailer. The engine is connected to a hydraulic pump, thereby supplying the machine with hydraulic power. A main hydraulic valve is mounted on the trailer for controllably feeding hydraulic fluid for various hydraulic actuators. An operator control panel includes various controls, an indicator panel, and a microprocessor, which is discussed in more detail below.

Figure 6:
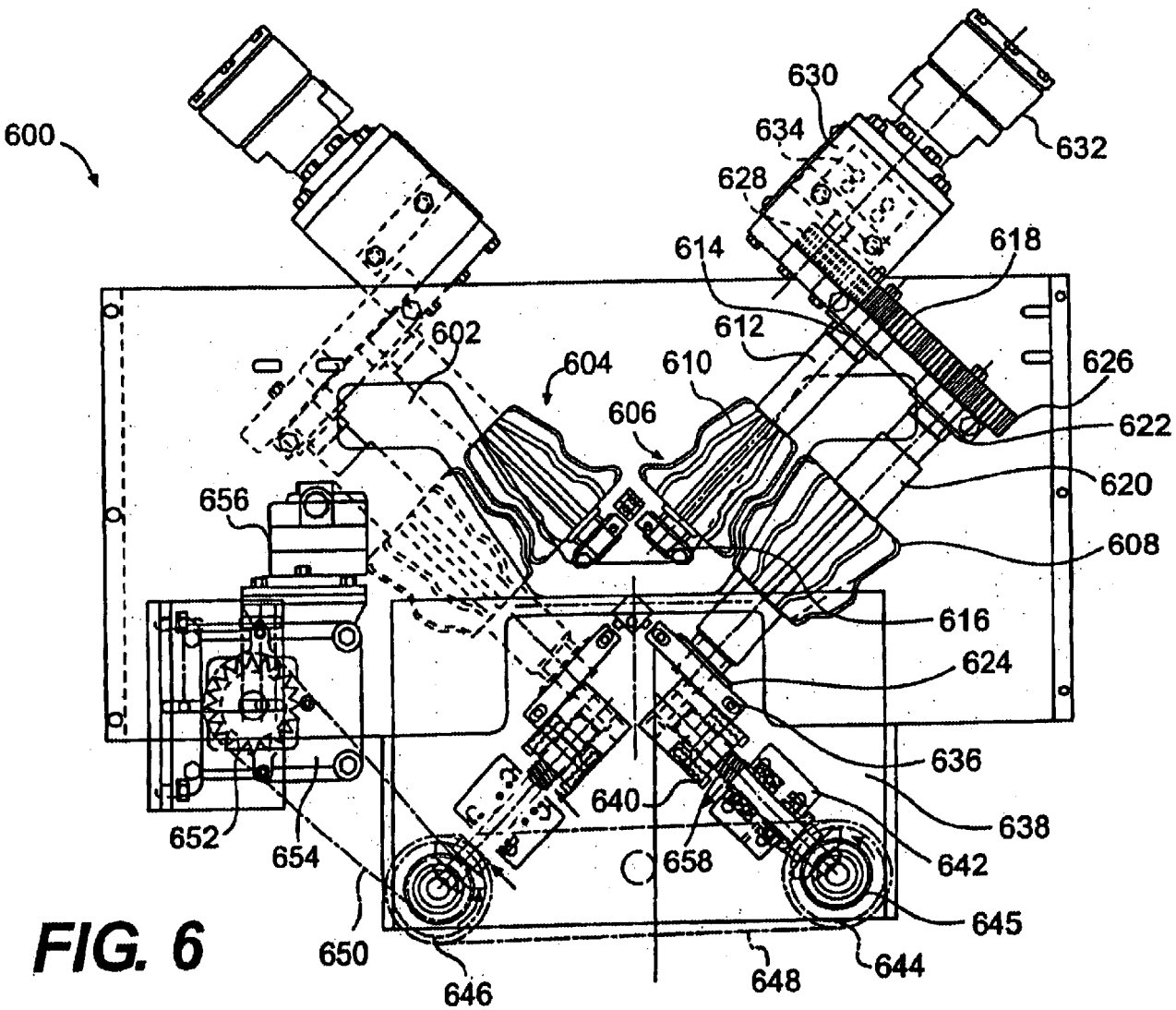
FIG. 6 is a plan view of one embodiment of a panel crimping machine capable of crimping the side wall portions of the building panel of the present invention as illustrated in FIG. 3.

Referring to FIG. 6, after the panels are formed into the desired profile and sheared to an appropriate length, the panels enter a panel crimping machine 600, which is typically located on the trailer on the side opposite the panel forming apparatus. The panel crimping machine 600 includes two sets of crimping rollers 604, 606. The sets of crimping rollers 604, 606 are located within the panel crimping machine 600 such that when a panel having notched side wall portions, as described above in reference to FIG. 3, enters the panel crimping machine 600 through slot 602, one side wall portion passes through one set of crimping rollers 604 and the other side wall portions passes through the other set of crimping rollers 606.

Figure 9:
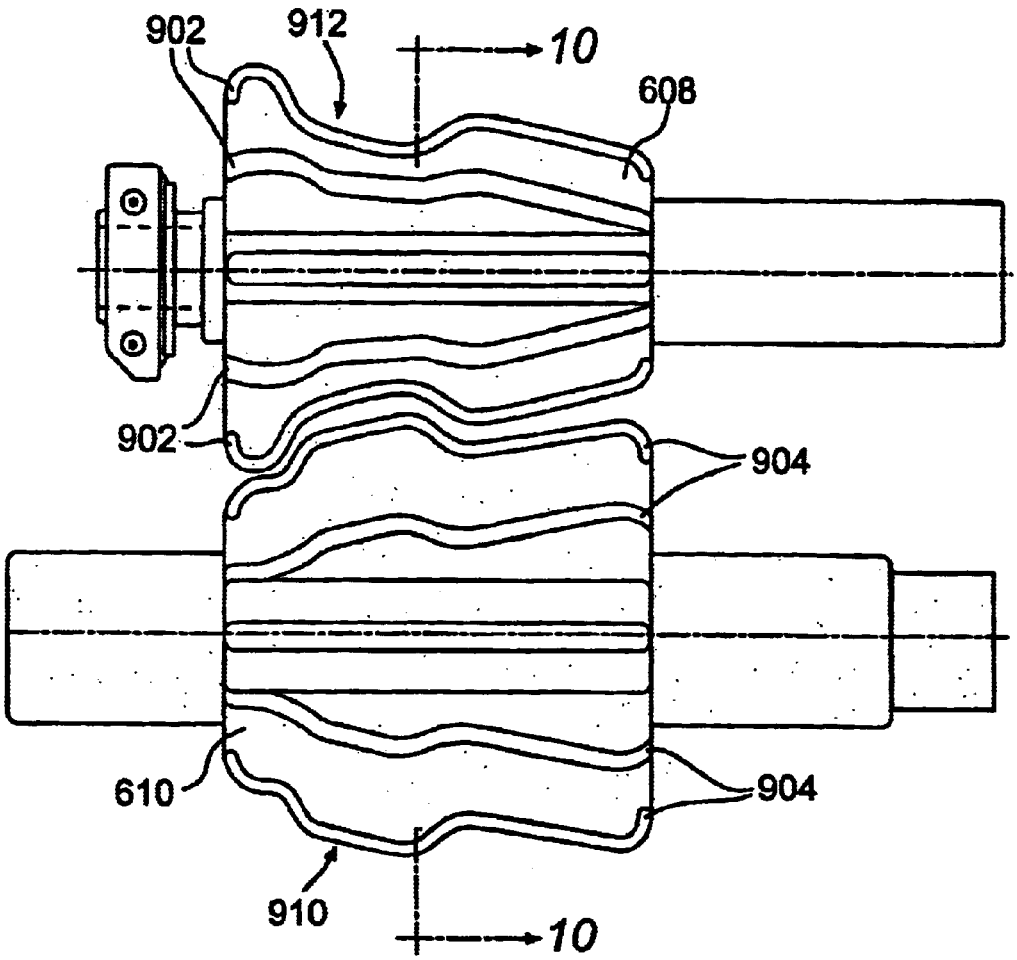
FIG. 9 is an enlarged view of the crimping rollers illustrated in FIG. 6.
Figure 10:
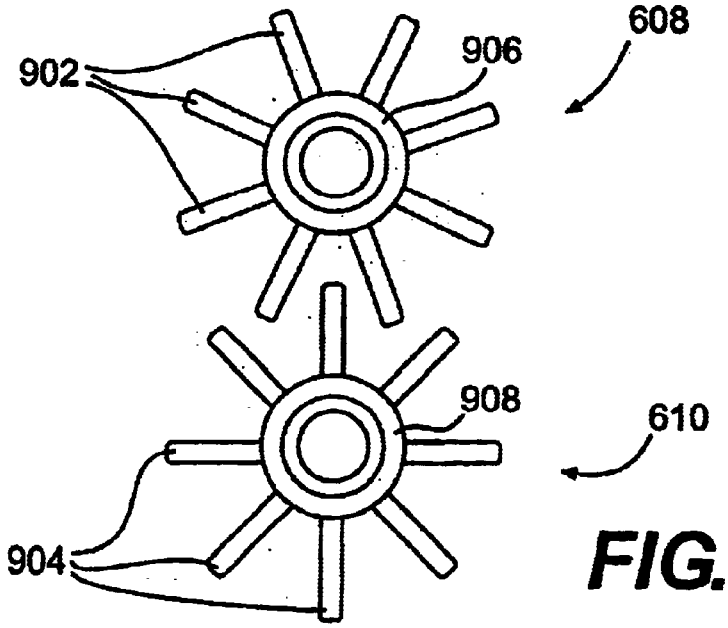
FIG. 10 is a cross sectional view of the crimping rollers illustrated in FIG. 9 taken along line 10—10.

Referring to FIGS. 9 and 10, each set of crimping rollers includes a pair of male and female crimping rollers 608, 610 that are designed to accommodate the profile of the notched inclined side wall portions of the panel. Both the male and female crimping rollers 604, 606 include a plurality of crimping blades 902, 904 extending from their respective hubs 906, 908. The profiles of the male crimping blades 902 and the female crimping blades 904 are non-linear in order to accommodate for the notched profile of the inclined side walls. Moreover, the male crimping blade 904 is configured such that it has a protrusion 910 extending from its outer edge, and the female crimping blade 902 has a recession 912 impressed within its outer edge.

It is also preferable that location of the male and female crimping rollers 608, 610, along with their non-linear profiled male and female crimping blades 904, 902, be located within the crimping machine to allow for the desired configuration of the panel, as illustrated in FIG. 3 above, to pass therethrough. Specifically, it is preferable that the male and female crimping rollers 608, 610 be located within the crimping machine at a location to allow a panel having notched inclined side wall portions to pass therethrough, wherein the notched portions are between the panel's neutral axis and the central portion. It is even more preferable that the location and design of the crimping rollers 608, 610 accommodate notched portions included approximately halfway between the panels neutral axis and its central portion. It is also preferable that the combined configuration of the male and female crimping rollers and their blades allow for the open and closed ends of the notched portion to face toward or away from the panel depending upon the panel's profile.

As each notched side wall portion of the panel passes through the crimping rollers 608, 610, the rollers rotate and crimp (i.e., corrugate) the side wall portion of the panel. Referring back to FIGS. 9 and 10, as the panel passes through the crimping rollers 608, 610, the male and female profiled blades 906, 908 intersect one another, thereby crimping the entire inclined side wall portion of the panel. Specifically, as illustrated in FIG. 5, the crimping rollers 608, 610, create corrugations in both the notched profile portion and flat profile portion of the side wall.

Referring back to FIG. 6, the rotating action of the crimping rollers 608, 610, is created by a mechanical drive system. The mechanical drive system includes a spur gear 626 attached to one end of a shaft 620, wherein the shaft 620 extends through the male crimping roller 608. The shaft 620 is supported at both of its ends by bearings 622, 624, thereby allowing the shaft 620 to rotate thereabout. Similarly, the mechanical drive system also includes a second spur gear 618 that is attached to one end of a separate shaft 612. This separate shaft 612 extends through the female crimping roller 610 and is supported at both of its ends by bearings 614, 616, thereby allowing the shaft 612 to rotate thereabout.

The spur gears 618, 626 align with one another and matingly engage such that when one gear turns in a clockwise direction, the other gear turns at the same speed in a counter-clockwise direction. Thus, as the spur gears 618, 626 rotate, so do the female and male crimping rollers. Both spur gears 618, 626 are driven by an idler worm gear 628, which is connected to a hydraulic motor 632 via a hub 630. The idler worm gear 628 is aligned with and engages the spur gear 618. Therefore, as the motor 632 rotates, the idler worm gear 628 rotates, thereby turning the spur gears 618, 626. Although the mechanical drive system has been explained for rotating one set of crimping rollers, it shall be understood that a similar system is connected to the other set of crimping rollers, as illustrated in FIG. 6.

Continuing to refer to FIG. 6, a clutch, and preferably a reversing clutch, is located between the motor 632 and the idler worm gear 628. If it is also desirable to corrugate (i.e., crimp) the central portion of the panel, in addition to corrugating the side wall portions, it may be preferable to include another set of crimping rollers within the crimping machine. The crimping rollers used to corrugate the central portion of the panel are often referred to as the main crimping rollers and are discussed in more detail below in reference to FIG. 8.

The main crimping rollers, however, may travel at a different speed than the crimping rollers used to corrugate the side wall portion of the panel. Preferably the main crimping rollers rotate slightly faster than the crimping rollers used to corrugate the side wall portion of the panel. Therefore, the main crimping rollers pull the panel through the crimping machine as the side wall crimping rollers corrugate the side wall portions.

The panel, however, is solid and cannot travel at different speeds. Moreover, if the side wall crimping rollers and the main crimping rollers travel at different speeds, the panel will become scratched and damaged. Therefore, it would be preferable to occasionally disengage one set of crimping rollers when both the side wall crimping rollers and the main crimping rollers operate simultaneously. Thus, the present invention includes a clutch attached to the drive mechanism, which rotates the side wall crimping rollers 604, 606. When the crimping rollers 604, 606 begin to rotate at a speed in excess of the main crimping rollers, the clutch is activated and the drive mechanism for the side wall crimping rollers 604, 606 temporarily disengages, thereby protecting the panel from damage.

The depth of the corrugations is controlled by the depth of the rotating intersection of the male and female crimping blades 902, 904. Therefore, the present invention further includes a gap adjusting system, which is illustrated in FIG. 6. The gap adjusting system controls the depth of the rotating crimping blades 902, 904 by adjusting (i.e., changing) the distance between the male and female crimping rollers 608, 610. As mentioned above, the male crimping roller 608 is connected to a shaft 620, which is supported at one end by bearing 624. This bearing 624 rests upon a support base 638 and is allowed to slide along the top of the support base 638. As the bearing 624 slides along the top of the support base 638, the relative distance between the crimping rollers 608, 610 changes. For example, assuming the female crimping roller 606 remains fixed, as the bearing 624 slides back and forth along the top of the support base 638, the male crimping roller 608 moves toward or away the female crimping rollers 610, thereby adjusting the gap between such rollers.

This gap adjusting system is made possible because the bearing 624 is secured to the support base 638 by a slot and bolt arrangement 636. In other words, the base of the bearing 624 includes a slot and the bolts restrain the bearing from moving in the vertical direction but allow the bearing to move in a guided horizontal direction. The movement of the of the bearing 624, however, is limited by the length of the slot therein. Thus, the movement of the gap adjusting system is also limited by the length of the slot.

The bearing 624 is attached to a moveable block 640, which in turn is connected to a fixed block 642 via a threaded shaft 658. The other end of the fixed block 642 is connected to sprocket 644 via a gear arrangement. In summary, this configuration converts rotary motion to linear motion, thereby allowing an operator to control the gap between the crimping rollers 608, 610 by creating a rotary adjustment.

Figure 7:
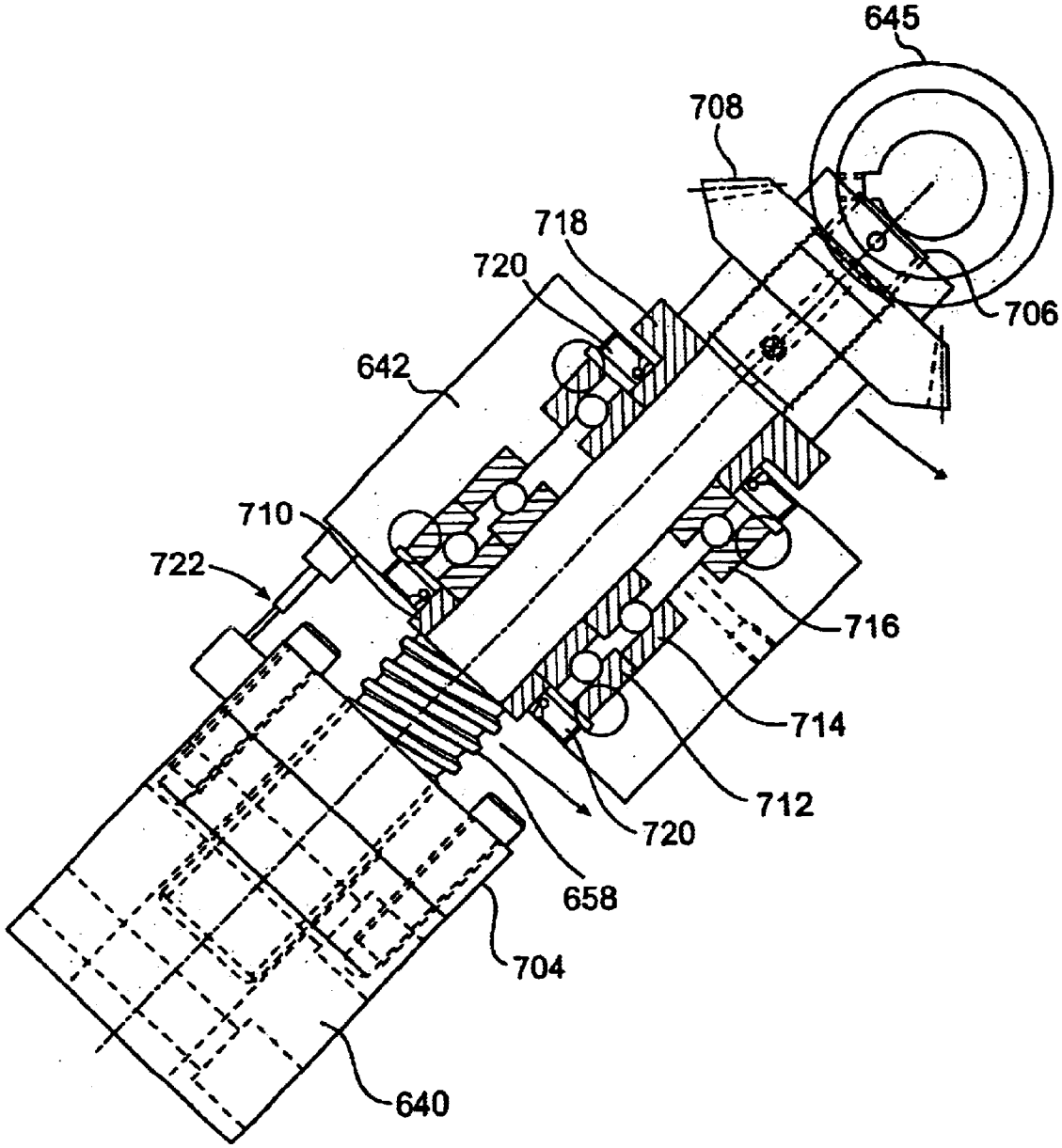
FIG. 7 is an enlarged plan view of a portion of the embodiment illustrated in FIG. 6.

Referring to FIG. 7, there is shown a more detailed illustration of this configuration. The threaded shaft 658 is connected to a nut 704, and as the threaded shaft 658 rotates, the nut 704 wishes to turn but is prevented from doing so because it is bolted to the sliding block 640. Thus, the sliding block 640 moves in a horizontal direction. The horizontal direction that the sliding block 640 travels is dependent upon whether the threaded shaft 658 has a right or left had thread arrangement and whether the threaded shaft 658 rotates in a clockwise or counter-clockwise direction.

The other end of the threaded shaft 658 enters the fixed block 642. The threaded shaft 658 is supported within the fixed block 642 by thrust bearings 712, 714, 716. It is preferable to include two thrust bearings 712, 714 adjacent to one another at this end of the fixed block 642 because the majority of the thrust within the fixed block 642 is absorbed at the end closest to the threaded portion of shaft 658. This end of the fixed block 642 further includes a seal 710 and collar 720.

The opposite end of the fixed block 642 also includes a seal 720 and thrust collar 718. The non-threaded portion of the shaft 706 extends from thrust collar 718 and is connected to a miter gear 78, which matingly engages another miter gear 645 at a 90° angle.

Referring back to FIG. 6, the miter gear 645 is connected to the same rotating shaft that supports sprocket 644. Thus, as sprocket 644 rotates, so does the miter gear 645, which sets the sliding block 640 in motion. Continuing to refer to FIG. 6, the sprocket 644 is connected to a double sprocket 646 by a chain 648. The double sprocket 646 has the same specifications as sprocket 644. Thus, both the sprocket 644 and the double sprocket 646 rotate at the same rate.

The double sprocket 646 is, in turn, connected to sprocket 653 by a chain 650. Sprocket 653 is connected to the output shaft of a gear box 654, the other end of which is driven by a hydraulic motor 656. Thus, as the motor turns, the sprockets 646, 644 turn at the same rate, thereby allowing the gap between each set of male and female crimping rollers 608, 610 to remain equal to one another as the gap is adjusted.

As discussed in U.S. Pat. No. 5,584,198, which is hereby incorporated by reference, this gap adjustment may be controlled by a microprocessor. A microprocessor (not shown) controls the valves (not shown), which in turn control the hydraulic motor 656. The microprocessor also receives inputs from a digital encoder 722, which is mounted on the panel crimping machine such that the digital encoder 722 measures the position of the moveable block 640. Measuring the position of the moveable block 640 allows the microprocessor to calculate the gap between the male and female crimping rollers. The information obtained by the digital encoder 722 is relayed to the microprocessor. The microprocessor determines the depth the side crimpers should be at various predetermined locations along the length of the panel. Thus, the microprocessor makes this determination independent of the position of the main crimpers.

U.S. Pat. No. 5,359,371, which is hereby incorporated by reference, discloses other capabilities and functions of the mentioned microprocessor. In addition to the capabilities of described in that patent, the side crimper control function of the microprocessor has the ability to perform the following tasks:

- enable/disable the entire side crimper adjust function;
- determine the depth of crimp as a function of panel material thickness and radius at which the panel is being curved;
- control the direction and start/stop of the hydraulic motor 656 to reach the desired depth of crimp;
- control the speed of the hydraulic motor including a standard high and low speed;
- set electronic safety stops for the maximum and minimum depth of crimp;
- LCD readout of the rotary and linear encoder positions; and
- determine the position along the panel to begin adjusting as a function of the type of panel being formed, the speed at which the curver is being run, and the total change of depth.

Of course, the microprocessor may be used to carry out many other functions in addition to those mentioned above.

Figure 8:
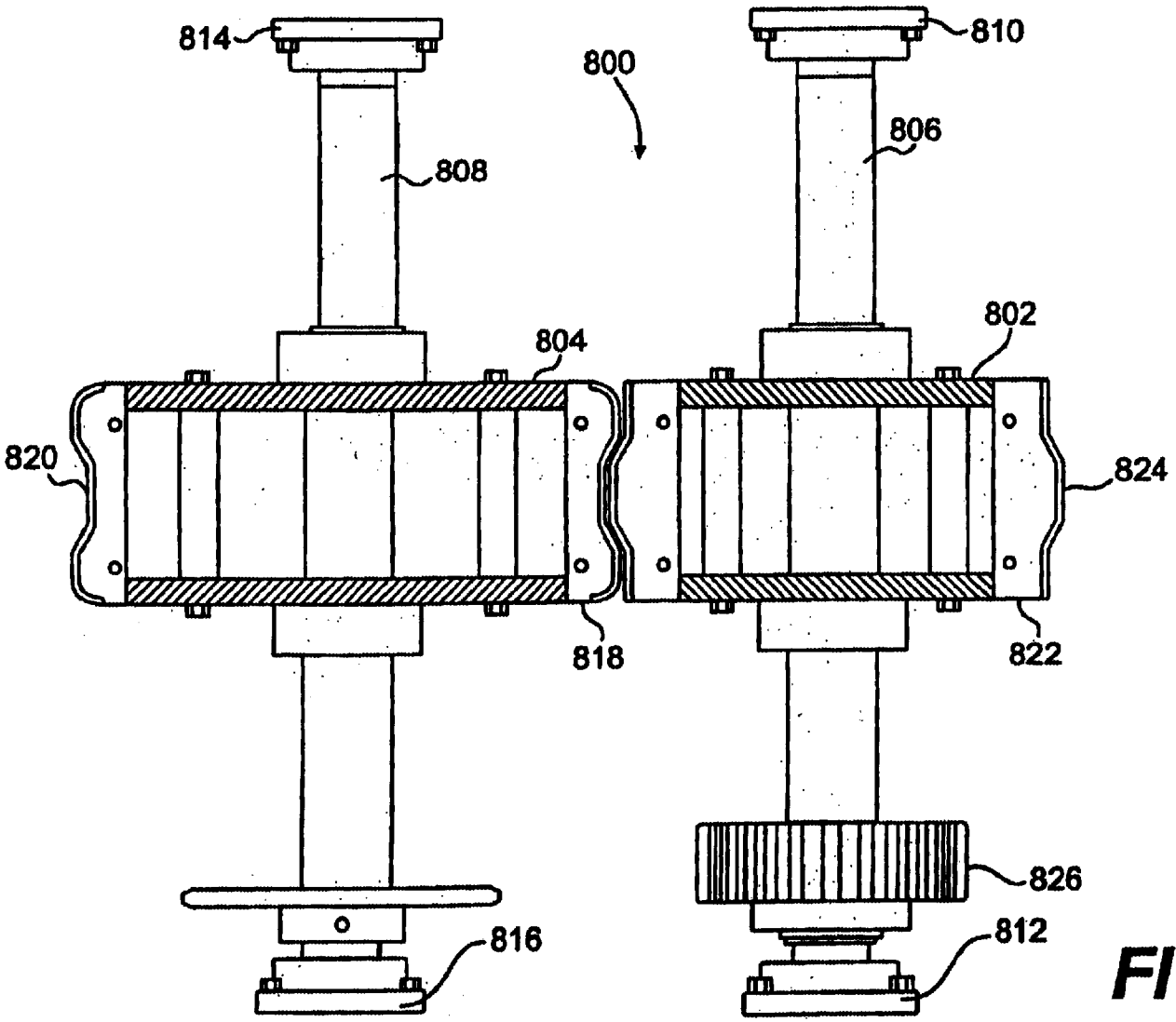
FIG. 8 is a plan view of an embodiment of a pair of crimping rollers for crimping the central portion of the building panel of the present invention as illustrated in FIG. 3.

Referring to FIG. 8, after the panel exists the two sets of crimping rollers 604, 606 that corrugate the inclined side portions of the panel, the panel may enter a third set of crimping rollers 800 that corrugate the central portion of the panel. As mentioned above, the third set of crimping rollers are is often referred to as the main set of crimping rollers. Assuming that the panel has a shape similar to that as described in FIG. 3 above, the panel will include a notched central portion. Thus, the third set of crimping rollers 800 includes male and female crimping rollers 802, 804 that accommodate a panel having a notched central portion.

More specifically, both the male and female crimping rollers 802, 804 include a plurality of respective crimping blades 822, 818 extending from their centers. The blades 822, 818 have a non-linear configuration in order to accommodate for the panel having a notched central portion. Particularly, the blade 820 attached to the female crimping roller 804 has a recess within the center of its circumference, and the blade 824 attached to male crimping roller 802 has a protrusion extending from its center. The recess in blade 820 and the protrusion of blade 802 have the same profile as the notched central portion of the panel described in reference to FIG. 3 above.

As similarly described in FIGS. 6 and 7 above, each of the crimping roller 802, 804 illustrated in FIG. 8 have shafts 806, 808 extending therethrough. The shaft 806 extending through the male crimping roller 802 is supported by bearings 810 and 812. The shaft 808 extending through the female crimping roller 804 is supported by bearings 814 and 816.

Additionally, both crimping roller 802, 804 are driven. Specifically, the male crimping roller 802 is driven by gear (or sprocket) 826, which is connected to shaft 806. Although the drive system for the female crimping roller 804 is not shown, the female crimping roller 804 is driven, and its drive system is connected to the male crimping roller's drive system. Furthermore, the gap between the two crimping roller 802, 804 is adjustable by a similar gap adjusting mechanism as described hereinbefore.

The present invention, therefore, includes a method and apparatus for crimping the notched side walls of a sheet metal panel independently of a crimping the central portion of the panel. The depth and position of the corrugations within the notched side walls is adjusted independently of the main crimping rollers. The independent adjustments include adjusting the radius that the panel is being curved and the length that the panel has passed through the crimping machine. Furthermore, these adjustments are microprocessor controlled. Particularly, the microprocessor controls the hydraulic motor that drives a series of sprockets and gears that ultimately turn a threaded shaft. The threaded shaft is connected to a sliding block and bearing that supports one of the crimping rollers. Thus, as the threaded shaft turns, one of the crimping rollers moves closer to or further away from the other crimping roller, thereby adjusting the gap between these crimping rollers.

Although the invention has been described and illustrated with respect to the exemplary embodiments thereof, it should be understood by those skilled in the art that the foregoing and various other changes, omissions and additions may be made without departing from the spirit and scope of the invention. For example, in lieu of facing the open end of the notched portions of the inclined side walls away from the panel, it may also be desirable to face the open end of the notched portions toward the center of the panel and the closed end of the notched portions away from the panel. For example, although the notched portion within the inclined side wall portions of the panel has been described as having an open side that faces away from the panel, it may also be desirable to face the open side toward the center of the panel. Additionally, the crimping device described hereinbefore includes main crimping rollers and two pairs of side wall crimping rollers. However, it may be desirable to corrugate only one of the side wall portions of the panel, only the central portion of the panel, or only the central portion and one side wall portion. If so, the appropriate sets of crimping rollers would be used.

What is claimed is:

1. A building panel, comprising:

(a) a central portion having opposite ends;

(b) a pair of inclined side wall portions extending from said opposite ends of said central portion, wherein an imaginary neutral axis intersects said inclined side wall portions, each of said inclined side wall portions comprising a notched portion between said imaginary axis and said central portion, said notched portion separating each of said inclined side wall portions into two substantially flat portions, said notched portion comprising an open side and a closed side, wherein said closed side is directed towards the center of said building panel; and (c) a pair of wing portions extending from said inclined side wall portions.

2. The building panel of claim 1, wherein said notched portion is located within each of said inclined side wall portions at a location halfway between said imaginary neutral axis and said central portion.

3. The building panel of claim 1, wherein said notched portion comprises:

a notched central side wall portion having opposite ends; and a pair of notched inclined side wall portions extending from said notched central side wall portion and connected to said flat portions of said inclined side wall portions.

4. The building panel of claim 3, wherein said notched central side wall portion is parallel to said flat portions of said inclined side wall portions.

5. The building panel of claim 4, wherein said notched inclined side wall portions extend from said notched central side wall portion at a minimum angle of approximately 45°.

6. The building panel of claim 3, wherein said notched inclined side wall portions extend from said notched central side wall portion at a minimum angle of approximately 45°.

7. The building panel of claim 1, wherein said inclined side wall portions extend from said central portion at a minimum angle of approximately 45°.

8. The building panel of claim 1, wherein said central portion comprises a central notched portion, thereby dividing said central portion into two central portions.

9. The building panel of claim 8, wherein said central notched portion comprises:

a horizontal portion having opposite ends; and a pair of central inclined side wall portions extending from said horizontal portion, each of said inclined side wall portions connected to one of said two central portions.

10. The building panel of claim 9, wherein said horizontal portion is parallel to said central portion.

11. The building panel of claim 10, wherein said central inclined side wall portions extend from said horizontal portion at a minimum angle of approximately 45°.

12. The building panel of claim 10, wherein said horizontal portion is at a height substantially horizontal with the intersection of said notched portion and one of said flat portions within said inclined side wall portions.

13. The building panel of claim 9, wherein said central inclined side wall portions extend from said horizontal portion at a minimum angle of approximately 45°.

14. The building panel of claim 1, wherein one of said wing portions comprises a hook and the other of said wing portions comprises a receptacle capable of receiving said hook from another building panel.

15. A building structure, comprising:

a plurality of interconnected panels, each of said panels comprising:

(a) a central portion having opposite ends;

(b) a pair of inclined side wall portions extending from said opposite ends of said central portion, wherein an imaginary neutral axis intersects said inclined side wall portions, each of said inclined side wall portions comprising a notched portion between said imaginary axis and said central portion, said notched portion separating each of said inclined side wall portions into two substantially flat portions, said notched portion comprising an open side and a closed side, wherein said closed side is directed towards the center of said building panel; and (c) a pair of wing portions extending from said inclined side wall portions, wherein one of said winged portions from a first of said panels is connected to one of said winged portions from a second of said panels.

16. The building panel of claim 15, wherein said notched portion is located within each of said inclined side wall portions at a location halfway between said imaginary neutral axis and said central portion.

17. The building panel of claim 15, wherein said notched comprises:

a notched central side wall portion having opposite ends; and a pair of notched inclined side wall portions extending from said notched central side wall portion and connected to said flat portions of said inclined side wall portions.

18. The building panel of claim 17, wherein said notched central side wall portion is parallel to said flat portions of said inclined side wall portions.

19. The building panel of claim 18, wherein said notched inclined side wall portions extend from said notched central side wall portion at a minimum angle of approximately 45°.

20. The building panel of claim 15, wherein said central portion comprises a central notched portion, thereby dividing said central portion into two central portions, said central notched portion comprising:

a horizontal portion having opposite ends, wherein said horizontal portion is parallel to said central portion, wherein said horizontal portion is at a height substantially horizontal with the intersection of said notched portion and one of said flat portions within said inclined side wall portions; and a pair of central inclined side wall portions extending from said horizontal portion, each of said inclined side wall portions connected to one of said two central portions.

* * * * *